United States Patent [19]

Bishop et al.

[11] 4,398,729

[45] Aug. 16, 1983

[54] BLOWOUT PREVENTER INNER RAM SEAL ASSEMBLY

[75] Inventors: Thomas R. Bishop; Archie W. Peil, both of Houston, Tex.

[73] Assignee: Bowen Tools, Inc., Houston, Tex.

[21] Appl. No.: 450,999

[22] Filed: Dec. 20, 1982

[51] Int. Cl.[3] ..... F16J 15/56; E21B 33/06

[52] U.S. Cl. ..... 277/73; 277/127; 277/198; 277/199; 251/1 A

[58] Field of Search ..... 251/1 R, 1 B, 1 A; 277/30, 31, 73, 192, 199, 127, 198

[56] References Cited

U.S. PATENT DOCUMENTS 2,090,206 8/1937 King ..... 277/73
2,912,214 11/1959 Allen et al. ..... 277/127
3,692,316 9/1972 Bishop et al. ..... 277/199 X

FOREIGN PATENT DOCUMENTS 594175 3/1960 Canada ..... 251/1 A

OTHER PUBLICATIONS

Bowen Tools, Inc., Manual No. 5/8505, pp. 8 and 9, 6/1979.

*Primary Examiner*—Robert S. Ward, Jr.
*Attorney, Agent, or Firm*—Pravel, Gambrell, Hewitt, Kirk & Kimball

[57] ABSTRACT

A new and improved inner seal assembly adapted to be mounted with the ram of a blowout preventer which includes a central sealing member and a seal insert, with the central sealing member being formed having at least one securing member receptacle capable of receiving a securing member formed with the seal insert, with the seal insert being removably mounted with the central sealing member by yieldable cooperation between the seal insert and the central sealing member.

13 Claims, 7 Drawing Figures

BLOWOUT PREVENTER INNER RAM SEAL ASSEMBLY

TECHNICAL FIELD OF THE INVENTION

This invention relates to an inner seal assembly adapted to be mounted with the ram of a blowout preventer, and are of the type that are particularly adapted to have a removable inner insert.

BACKGROUND OF THE INVENTION

It is known in prior art that ram seals are mountable with the ram of a blowout preventer. For example, as shown in U.S. Pat. No. 3,692,316, ram seals are mounted with the ram of a blowout preventer for sealingly engaging a wireline during typical wireline operations.

As discussed more fully hereinbelow, the prior art includes other types of inner seal assemblies that are adapted to receive removable wear inserts that are capable of taking the extreme punishment not uncommon in typical blowout preventer operations. For example, during typical stripping operations, depending upon the quality of tubular goods going into and out of a typical wellbore, it is not uncommon for wear inserts to be replaced multiple times. Because of the substantial expense per unit time incurred in the utilization of blowout preventers, time is of the essence in all such operations; and, therefore, reducing doown time for inner seal replacement is highly desirable.

Heretofore, the replacement of wear inserts and/or inner assemblies has been somewhat cumbersome and time comsuming, all of which tend to increase the overall expense of utilizing such a blowout preventer in typical operations thereof.

SUMMARY OF THE INVENTION

The present invention relates to a new and improved inner seal assembly adapted to be mounted with the ram of a blowout preventer which includes a central sealing member and a seal insert, with the central sealing member being formed having at least one securing member receptacle capable of receiving a securing member formed with the seal insert, with the seal insert being removably mounted with the central sealing member by yieldable cooperation between the seal insert and the central sealing member.

DESCRIPTION OF THE PREFERRED EMBODIMENT

Figure 1:
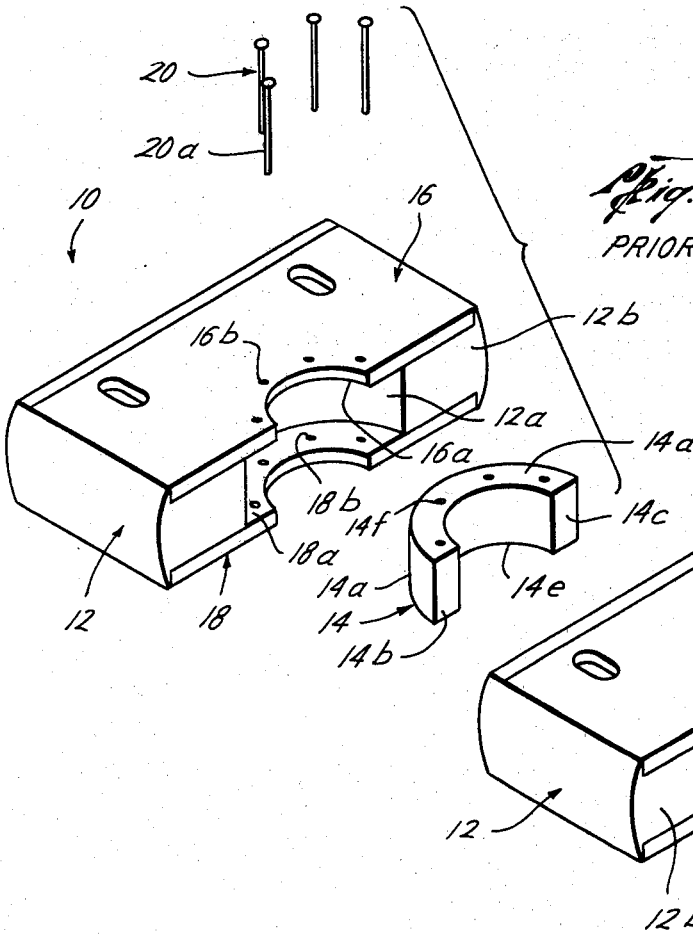
Fig. 1 PRIOR ART
FIG. 1 is an isometric, exploded view of an inner seal assembly of the prior art.

In the drawings, the inner seal assembly of the present invention is generally designated by the letter A. The inner seal assembly A generally includes a central sealing member S, which is adapted to receive a removably mounted seal insert I that is mounted therewith by yieldable cooperation between the central sealing member S and seal insert I, with the inner seal assembly A further including an upper plate member U and a lower plate member L.

Figure 2:
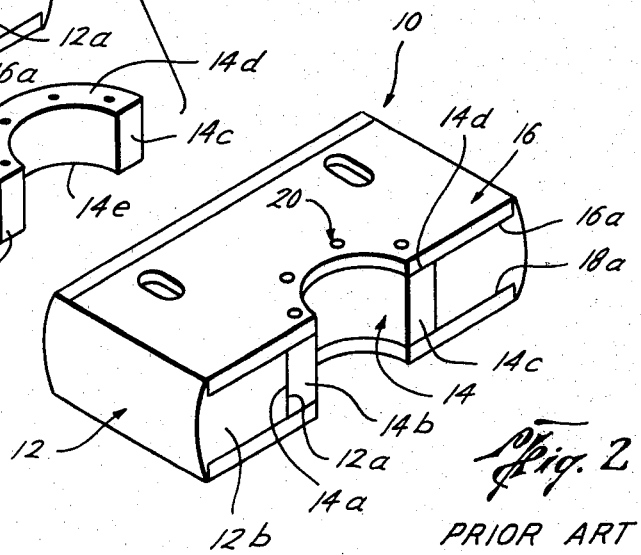
Fig. 2 PRIOR ART
FIG. 2 is an isometric view, similar to FIG. 1, showing the fully assembly inner seal assembly of the prior art.
Figure 3:
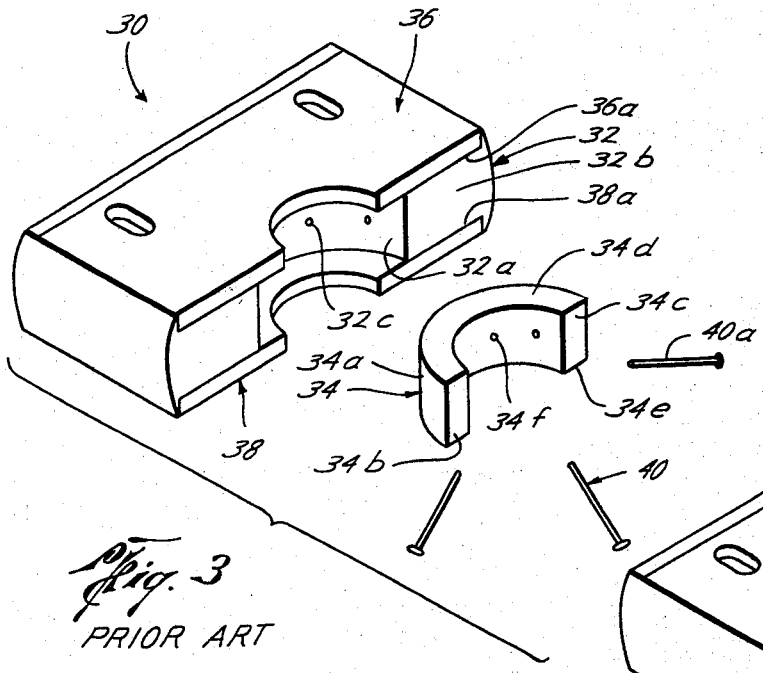
Fig. 3 PRIOR ART
FIG. 3 is an isometric, exploded view of a second embodiment of an inner seal assembly of the prior art.
Figure 4:
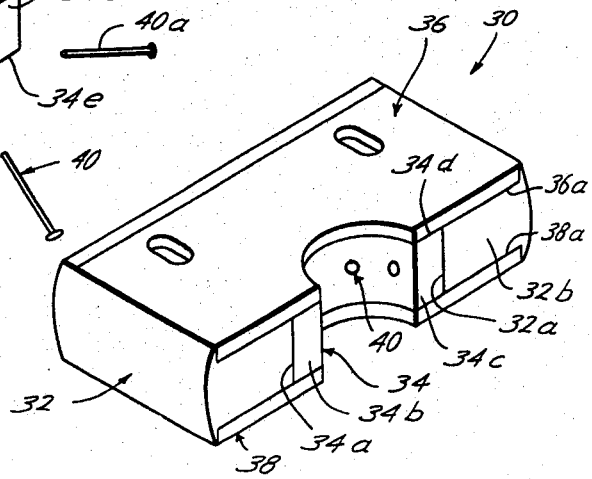
Fig. 4 PRIOR ART
FIG. 4 is an isometric view similar to FIG. 3, with the inner seal assembly of FIG. 3 fully assembled.
Figure 5:
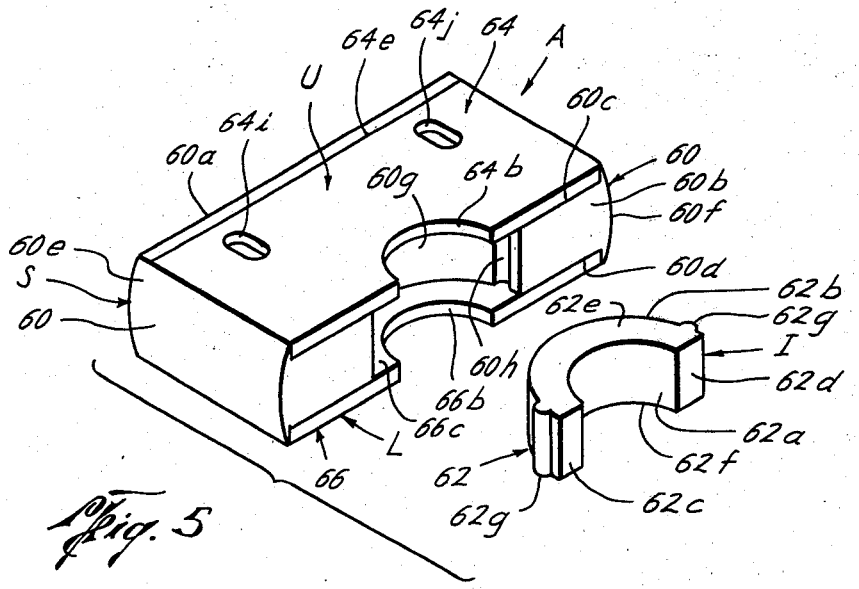
FIG. 5 is an isometric, exploded view of the inner seal assembly of the present invention.
Figure 6:
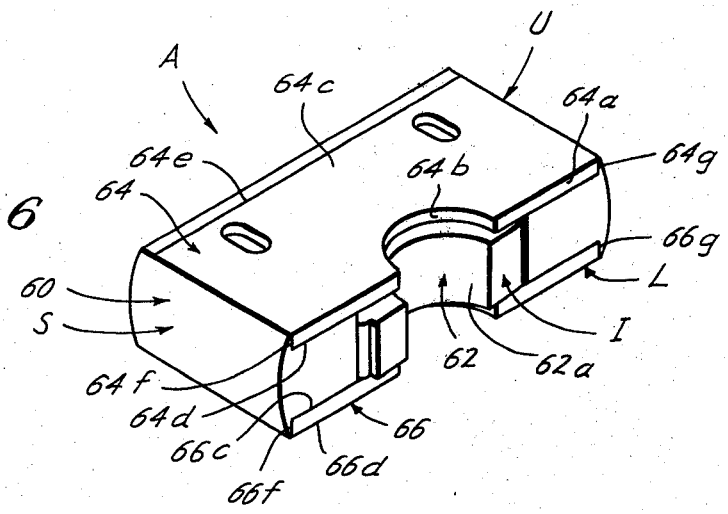
FIG. 6 is a view similar to FIG. 5, showing the seal insert partially mounted with the central sealing member of the inner seal assembly of the present invention; and, FIG. 7 is a view similar to FIGS. 5 and 6, with the seal insert fully mounted with the central sealing member of the inner seal assembly of the present invention.
Figure 7:
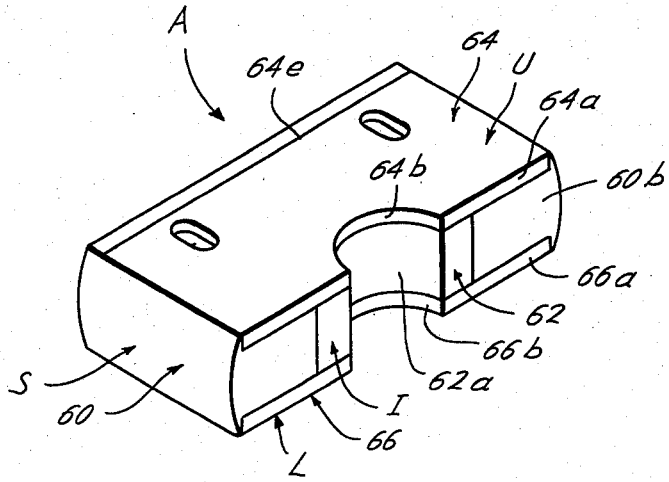

Before discussing the inner seal assembly A of the present invention as shown in FIGS. 5–7, two types of known prior art inner seal assemblies are discussed in FIGS. 1–4. The first type of inner seal assembly is shown in FIGS. 1 and 2. The inner seal assembly of FIGS. 1 and 2 is generally designated as assembly 10 which includes a central sealing members 12, a seal insert 14, an upper plate 16 and a lower plate 18. As such, the inner seal assembly 10 is formed such that the central sealing member 12 has a insert detent **12*a* formed with the sealing face 12*b* of the central sealing member 12. As such, the outer surface area 14*a*, of the seal insert is adapted to be in full face engagement with the insert detent 12*a* of the central sealing member 12. When the seal insert 14 is properly positioned with the central sealing member 12, not only does the outer surface area 14*a* fully engage insert detent 12*a* but also the seal face areas 14*b*, 14*c* are in substantial alignment with the sealing face 12*b* of the central sealing member 12. Furthermore, the upper surface 14*d* of the seal insert 14 is in close promixity with the lower surface 16*a* of upper plate 16 while the lower surface 14*e* of the seal insert is in close proximity to the upper surface 18*a* of the lower plate 18**.

The upper plate 16 is formed having a plurality of openings **16*b* formed therein as is lower plate 18 which has a plurality of openings 18*b* formed therein. Preferably the openings 16*b*, 18*b* are in axial, vertical alignment with one another. Upon proper placement of the seal insert 14 within the insert detent 12*a* of the central sealing member 12, the openings 16*b*, 18*b* are in alignment with compatibly formed openings 14*f* formed within seal insert 14. Upon placement of the seal insert 14 within the central sealing member 12 of the inner seal assembly 10, a suitable plurality of fasteners 20, which may include nails 20*a* or any other suitable elongated pins, are adapted to be driven through openings 16*b*, 14*f*, and 18*b* for securing the seal insert 14 with the upper plate 16, central sealing member 12, and lower plate 18 of the inner seal assembly 10. As such, the fasteners 20 prevent the seal insert 14 from becoming dislodged from the insert detent 12*a* of the central sealing member 12 during operation of the inner seal assembly 10 in a typical blowout preventer (not shown). An example of such a blowout preventer and preventer operations are shown in U.S. Pat. No. 3,692,316. As such, the extension of the fasteners 20 through the openings 16*b* of upper plate 16, 14*f* of seal insert 14, thereinto openings 18*b* of lower plate 18, secure the seal insert 14 with the inner seal assembly 10. However, upon the seal insert 14 becoming worn, requiring replacement thereof, it is not unusual to encounter difficulty in removal of the fasteners 20 prior to the extraction of the seal insert 14 for replacement thereof with an appropriate, new seal insert 14**.

As best seen in FIGS. 3 and 4, another known prior art inner seal assembly is shown as inner seal assembly 30. The inner seal assembly 30 includes generally a central sealing member 32, a seal insert 34, an upper plate 36 and a lower plate 38. The central sealing member 32 is formed with an insert detent 32*a* and a sealing face 32*b*. The seal insert 34 is formed of a generally arcuate configuration having an outer surface area 34*a*, seal face areas 34*b*, 34*c*, an upper surface 34*d*, a lower surface 34*e* and a plurality of substantially horizontally disposed, radial openings 34*f*. As in the inner seal assembly 10, the inner assembly 30 is configured that the outer surface area 34*a* of the seal insert 34 is adapted to be in full face engagement with the insert detent 32*a* of the central sealing member 32. When properly positioned, the upper surface 34*d* of the seal insert 34 is in close proximity to the lower surface of 36*a* of the upper plate 36 and the lower surface 34*e* of the seal insert 34 is in close proximity to a upper surface 38*a* of the lower plate 38. Upon proper positioning of the seal insert 34 with the central sealing member 32, the openings 34*f* formed in a seal insert 34 are positioned in alignment with horizontal, radial openings 32*c* forming in central sealing member 32. Suitable fasteners 40, which may include nails 40*a* or any other suitable elongated members, are adapted to be received within openings 34*f* in the seal insert 34 and openings 32*c* formed in central sealing member 32 for securing the seal insert 34 with the central sealing member 32 of the inner seal assembly 30. As with the inner seal assembly 10, the inner seal assembly 30 requires the removal of fasteners 40 prior to the exchange of a seal insert 34 upon such being worn out. In the case of inner seal assembly 30, extraction of the fasteners 40, may even be more difficult than those of the fasteners 20 of inner seal assembly 10 in that the fasteners 40 may be damaged during the overall wear of the seal insert 34 upon utilization of the inner assembly 30 within the blowout preventer (not shown). As such, the replacement of the seal insert 34 of the inner seal assembly 30 is not only cumbersome but also a time consuming operation to effectuate.

The inner seal assembly A of the present invention is shown in FIGS. 5–7 and includes generally, a central sealing member S and a seal insert I mountable therewith, with the central sealing member S generally sandwiched between an upper plate member U and a lower plate member L.

The central sealing member S of the inner seal assembly A of the present invention includes a sealing member 60 having a ram face 60*a*, a sealing face 60*b* that is substantially parallel with the ram face 60*a*, an upper surface 60*c*, a lower surface 60*d*, and side portions 60*e*, 60*f*. Preferably an insert detent designated generally as 60*g* is formed in sealing face 60*b* of the sealing member 60 of the central sealing member S. Preferably, the insert detent 60*g* is formed of an arcuate, semi-circular configuration and is formed having securing member receptacles 60*h* therein. As shown in FIG. 5, the sealing member receptacles 60*h* are preferably in the form of semi-circular detents formed in the insert detent 60*g* of the sealing member 60. Preferably, the sealing member 60 is formed of a suitable resilient material which may include a nylon, and/or urethane materials or may further include a nitrile-butadiene material, commonly known as "NBR", all of which are preferably moldable as discussed more fully hereinabelow.

The inner seal assembly A of the present invention further includes seal insert I. The seal insert I includes a seal insert 62 which has an inner sealing surface area 62*a*, an outer surface area 62*b*, seal face areas 62*c*, 62*d*, and upper surface 62*e* and a lower surface 62*f*. The seal insert 62 thus has a perimeter generally formed of the inner sealing surface area 62*a*, outer surface area 62*b* and seal face areas 62*c*, 62*d*. Preferably outwardly projecting securing members 62*g* are formed with the outer surface area 62*b* of the seal insert 62. As shown in FIG. 5, preferably the securing members 62*g* are of a substantially semi-circular configuration and are adapted to be receivably mounted in the securing member receptacles 60*h* of the sealing member 60, as discussed more fully hereinbelow. Alternatively, other suitable configurations of the securing member 62*g* and securing member receptacle 60*h* may be used. Preferably, the seal insert 62 of the seal insert I may be formed of a suitable material such as a copolyester thermoplastic elastomer such as that manufactured by I. E. DuPont & Co. under the trademark HYTREL. As such, the inner sealing surface area 62*a* and outer surface area 62*b* are preferably substantially parallel with one another and form an arcuate semi-circular configuration; however, any other suitable configuration may be used, such as by way of example, the outer surface area 62*b* may be formed of a rectangular or any multi-sided configuration so long as the insert detent 60*g* of the sealing member 60 is compatibly formed to correspond therewith.

The inner seal assembly A of the present invention further includes an upper plate member U and a lower plate member L, which includes plate members 64, 66, respectively. The plate members 64, 66 include first faces 64*a*, 66*a*, inner insert faces 64*b*, 66*b*, upper surfaces 64*c*, 66*c*, lower surfaces 64*d*, 66*d*, second faces 64*e*, 66*e*, first side surfaces 64*f*, 66*f* and second side surfaces 64*g*, 66*g*, respectively. Preferably, the upper plate member U and lower member L are formed of steel or other suitable high strength materials.

It is preferred that the inner seal assembly A of the present invention be formed with the upper plate member U and lower plate member L being molded with the central sealing member S such that the central sealing member S is generally sandwiched between the upper plate member U and the lower plate member L. In the molding process thereof, it is preferred that the material of the central sealing member S be such that it may be formed with side portions 60*e*, 60*f* extending from the upper surface 64*c* of the upper plate member 64 to the lower surface 66*d* of the lower plate member 66 in a substantially arcuate configuration, such that the first and second side surfaces 64*f*, 64*g*, 66*f*, 66*g*, respectively, are covered with the material of the sealing member and are not exposed. Furthermore, it is preferred that the second face 64*e*, 66*e* of the plate members 64, 66, respectively, are encapsulated and covered with sealing material 60 so that none of the second faces 64*e*, 66*e*, are exposed.

When the inner seal assembly A of the present invention is properly formed, the first faces 64*a*, 66*a* are aligned with the sealing face 60*b* of the sealing member 60 and inner insert faces 64*b*, 66*b* are aligned with one another. As noted above, the material of the central sealing member S and the seal insert I are preferably resilient such that they are capable of yieldable cooperation between one another to enhance the ease of mounting and/or removal of the seal insert I when using the inner seal assembly A of the present invention, as discussed more fully hereinbelow.

In the use or operation of the inner seal assembly A of the present invention, preferably the inner seal assembly A is mounted with a suitable blowout preventer (not shown). Typically, slots such as 64*i*, 64*j* are formed in the upper plate member 64 and/or similar slots (not shown) may be formed in the lower plate member L for receiving a suitable retaining device with the blowout preventer ram to prevent the inner seal assembly A from inadvertently becoming dislocated from the ram of the blowout preventer, such as shown in U.S. Pat. No. 3,692,316. When properly mounted with the ram, the ram face 60*a* of the central sealing member S abutts a compatibly formed surface of the ram. Furthermore, the side portions 60*e*, 60*f*, which are preferably of a arcuate configuration, may also correspond to the diameter of the ram bore within the blowout preventer. As such the slots 64, 64*j*, insure proper orientation of the inner seal assembly A within the ram of the blowout preventer.

The seal insert I may be received with the central sealing member S either prior to or after mounting of the inner seal assembly A with the blowout preventer ram. When it is desired to properly mount the seal insert I with the central sealing member S, the seal insert I need only positioned such that one of the seal face areas 62*c*, 62*d* be in close proximity to the sealing face 60*b* of the seal member 60. As such, the outwardly projecting securing member 62*g* is in close proximity to the securing member receptacle 60*h* formed in insert detent 60*g*. Forcing the seal insert I into the insert detent 60*g* results in the securing member receptacles 60*h* receiving the outwardly projecting securing members 62*g* of the seal insert 62. By yieldable cooperation between the seal insert I and central sealing member S, the materials of the central sealing member S, seal insert I and/or both resiliently flex, permit the momentary deformation of the central sealing member S and/or seal insert I to permit the seal insert I to be forced into the central sealing member S. As such, the seal insert I is constrained between the lower surface 64*d* of the upper plate 64 and the upper surface 66*c* of the lower plate member 66, with the upper surface 62*e* of the seal insert 62 being proximately located adjacent to the lower surface 64*d* of plate member 64 and the lower surface 62*f* of the seal insert 62 being proximately located adjacent the upper surface 66*c* of plate member 66. Furthermore when properly positioned, the seal face areas 62*c*, 62*d* are aligned with the sealing face 60*b* of the sealing member 60 and the inner sealing surface area 62*a* of the seal insert 62 is aligned with the inner insert faces 64*b*, 66*b* of the plate members 64, 66, respectively. Alternatively, when it is desired to remove the seal insert I from the central sealing member S of the inner seal assembly A, a suitable tool (not shown), such as a screwdriver or the like, may be wedged between the outer surface area 62*b* of the seal insert 62 and the insert detent 60*g* adjacent sealing face 60*b* for prying the seal insert 62 from the sealing member 60. Again, the yieldable deformation and resilient characteristics of the materials of the sealing member 60 and seal insert 62 permit the removal of the seal insert 62 in prompt fashion.

As is known, blowout preventers, for example, are typically used in all types of stripping operations wherein tubular or cylindrical members are run into a wellbore under pressure, requiring the pressure to be maintained by a suitable blowout preventer. During such typical running operations, significant wear is encountered by the inner seal of the blowout preventer. By using the inner seal assembly A of the present invention, wear may be confined primarily to a seal insert I which is adapted to be quickly removed and replaced without the use of fasteners such as fasteners 20, 40 in FIGS. 1–4. By removing the need for such fasteners 20, 40, the seal insert I may be quickly replaced to minimize down time of well operations for seal replacement. Furthermore, by removing fasteners such as fasteners 40, the risk that the nails 40*a* will damage the tubular members or cylindrical members going into the wellbore is not only minimized but eliminated. While it is not unusual to encounter significant wear on seal inserts I, which may be caused by a variety of factors including corrosive environmental effects, high pressures, as well as poor quality surfaces of the tubular members and/or cylindrical members going into the well, at least the use of resiliently mountable seal inserts I enhances the ease with which the inner seal assembly A of the present invention may be maintained in an operational, functional fashion with the blowout preventer. Thus, the inner seal assembly A of the present invention provides a new and improved inner seal assembly A capable of enhancing the effectiveness of the blowout preventer operation.

The foregoing disclosure and description of the invention are illustrative and explanatory thereof, and various changes in the size, shape and materials, as well as in the details of the illustrated construction may be made without departing from the spirit of the invention.

We claim:

1. An inner seal assembly adapted to be mounted with a ram of a blowout preventer, comprising:

a central sealing member for mounting with the ram of the blowout preventer, said central sealing member having a sealing face and a ram face, said sealing face and said ram face being substantially parallel to one another, said sealing face formed having an insert detent formed therewith, said insert detent formed in said central sealing member extending from said sealing face towards said ram face;

a seal insert having a perimeter formed of an inner sealing surface area, an outer surface area, and a seal face area;

said outer surface area of said seal insert formed having at least one outwardly projecting securing member;

said insert detent having at least one securing member receptacle formed therewith for receiving said securing member of said seal insert;

said seal insert being removably mounted with said central sealing member by yieldable cooperation between said seal insert and said central sealing member; and said outer surface area of said seal insert engaging said insert detent of said central sealing member and said securing member being received in said securing member receptacle, with said seal face area of said seal insert in alignment with said sealing face of said central sealing member.

2. The inner seal assembly of claim 1, further including:

an upper plate member;

a lower plate member; and, said central sealing member is formed having an upper surface and a lower surface, said upper plate member is with said upper surface and said lower plate member with said lower surface.

3. The inner seal assembly of claim 2, wherein:

said upper and lower plate members are substantially parallel to each other;

said upper and lower plate members each have a first face which is adapted to be in substantial alignment with said sealing face of said central sealing member; and, said upper and lower plate members are formed having inner insert faces which are adapted to be substantially aligned with said inner sealing surface area of said seal insert.

4. The inner seal assembly of claim 3, wherein:

said upper and lower plate members are each formed having a perimeter including said first face, a second face, and two side surfaces joining said second face with said first face of said plate members; and, said upper and lower plate members mounted with said central sealing members such that said central sealing member encapsulates said rear face and said side surfaces of said upper and lower plate members.

5. The inner seal assembly of claim 2, wherein:

said central sealing member is formed having side portions of an arcuate configuration that extend between an upper surface of said upper plate member and a lower surface of said lower plate member.

6. The inner seal assembly of claim 2, wherein:

said upper and lower plates are bonded with said said central sealing member.

7. The inner seal assembly of claim 2, wherein:

said upper plate is formed having a lower surface and said lower plate member is formed having an upper surface;

said seal insert is formed having an upper surface and a lower surface, with said upper surface of said seal insert proximately disposed adjacent said lower surface of said upper plate member and said lower surface of said seal insert being proximately disposed adjacent said upper surface of said lower plate member.

8. The inner seal assembly of claim 1, wherein:

said seal insert is of a resilient material permitting deformation thereof for enhanced yieldable cooperation and removable mounting of said seal insert with said central sealing member.

9. The inner seal assembly of claim 1, wherein:

said central sealing member is of a resilient material permitting deformation thereof for enhanced yieldable cooperation and removable mounting of said seal insert with said central sealing member.

10. The inner seal assembly of claim 1, wherein:

said seal insert and said central sealing member are both of a resilient material and capable of being deformed for enhancing the yieldable cooperation between said central sealing member and said seal insert for removable mounting of said seal insert with said central sealing member.

11. The inner seal assembly of claim 1, wherein:

said seal insert is of a substantially semi-circular configuration with said inner sealing surface area and said outer surface area of said seal insert being substantially parallel to one another.

12. The inner seal assembly of claim 1, wherein:

said securing members of said seal insert are of a substantially semi-circular configuration and are adapted to be received in said securing member receptacle of a compatibly formed semi-circular configuration.

13. The inner seal assembly of claim 1, wherein:

said outer surface area of said seal insert is in full engagement with said insert detent formed in said central sealing member.

* * * * *